United States Patent [19]

Wagner

[11] 3,959,896

[45] June 1, 1976

[54] SELF-LOADING SCRAPER WITH PIVOTAL FLOOR PANEL

[75] Inventor: Ernest W. Wagner, Joliet, Ill.

[73] Assignee: Caterpillar Tractor Co., Peoria, Ill.

[22] Filed: Feb. 7, 1975

[21] Appl. No.: 547,908

[52] U.S. Cl. ..... 37/8; 37/126; 37/129

[51] Int. Cl.[2] ..... E02F 1/00; B60P 1/38

[58] Field of Search ..... 37/8, 124, 126, 129

[56] References Cited

UNITED STATES PATENTS

| | | | |
|---|---|---|---|
| 3,108,388 | 10/1963 | Johnson | 37/8 X |
| 3,210,868 | 10/1965 | Liess | 37/126 R X |
| 3,331,149 | 7/1967 | Rapp | 37/8 |
| 3,483,640 | 12/1969 | Anderson et al. | 37/8 |
| 3,646,693 | 3/1972 | Simmons | 37/8 |
| 3,675,347 | 7/1972 | Stewert et al. | 37/126 AE |

*Primary Examiner*—Stephen C. Pellegrino
*Attorney, Agent, or Firm*—Phillips Moore, Weissenberger, Lempio & Strabala

[57] ABSTRACT

A self loading scraper comprises a bowl preferably having an elevator assembly mounted forward thereon and a normally retracted ejector movably mounted in the bowl for unloading purposes. The floor of the bowl comprises stationary first and second longitudinally spaced panels secured between sidewalls of the bowl to define an opening therebetween and a movable panel pivotally mounted on the first panel and adapted to be pivoted to a closed position over such opening. In a first embodiment of this invention, a double-acting cylinder is interconnected between the first panel and the movable panel whereas in a second embodiment thereof a double-acting cylinder is pivotally interconnected between a sidewall of the bowl and a lever attached to the movable panel.

11 Claims, 6 Drawing Figures

SELF-LOADING SCRAPER WITH PIVOTAL FLOOR PANEL

BACKGROUND OF THE INVENTION

This invention relates to a self-loading scraper of the type illustrated in U.S. Pat. No. 3,452,458, assigned to the assignee of this application, wherein at least a portion of the floor of the scraper bowl is adapted to be opened to facilitate the unloading of material contained in the bowl. In conventional scrapers, the movable floor portion is normally either slidably mounted on the bowl or is pivoted for rearward movement in the bowl to at least partially impede the unloading phase of scraper operation. In addition to the desirability of expeditiously and evenly unloading material from the bowl, it is further desirable that a complete emptying of the bowl be achieved.

SUMMARY OF THIS INVENTION

An object of this invention is to provide an improved self-loading scraper of the type discussed above wherein a pivotal floor panel thereof is constructed and arranged to aid in the expeditious and uniform unloading of material from the bowl thereof. The bowl preferably has an elevator assembly mounted on a forward end thereof and an ejector assembly normally retracted to a rearward end of the bowl. The floor of the bowl comprises stationary first and second panels secured between the sidewalls thereof in longitudinally spaced relationship to define an opening therebetween. A cutting edge is secured on a forward end of the first panel, adjacent to a lower end of the elevator assembly, and a movable panel has its first end pivotally mounted on the first panel and a second end thereof normally disposed adjacent to a forward end of the second panel to fully cover the opening formed therebetween.

Actuating means, preferably comprising at least one double-acting cylinder, are operatively interconnected between the movable floor panel and the bowl for selectively pivoting the floor panel towards the elevator assembly during the unloading phase of scraper operation. Pivoting of the floor panel in a generally upright position, adjacent to the elevator assembly, aids in discharging material therebetween and also forms a baffle or back-up member cooperating with the ejector assembly for assuring complete and controlled discharge of material through the opening formed in the floor.

BRIEF DESCRIPTION OF THE DRAWINGS

Other objects of this invention will become apparent from the following description and accompanying drawings wherein.

DETAILED DESCRIPTION

Figure 1:
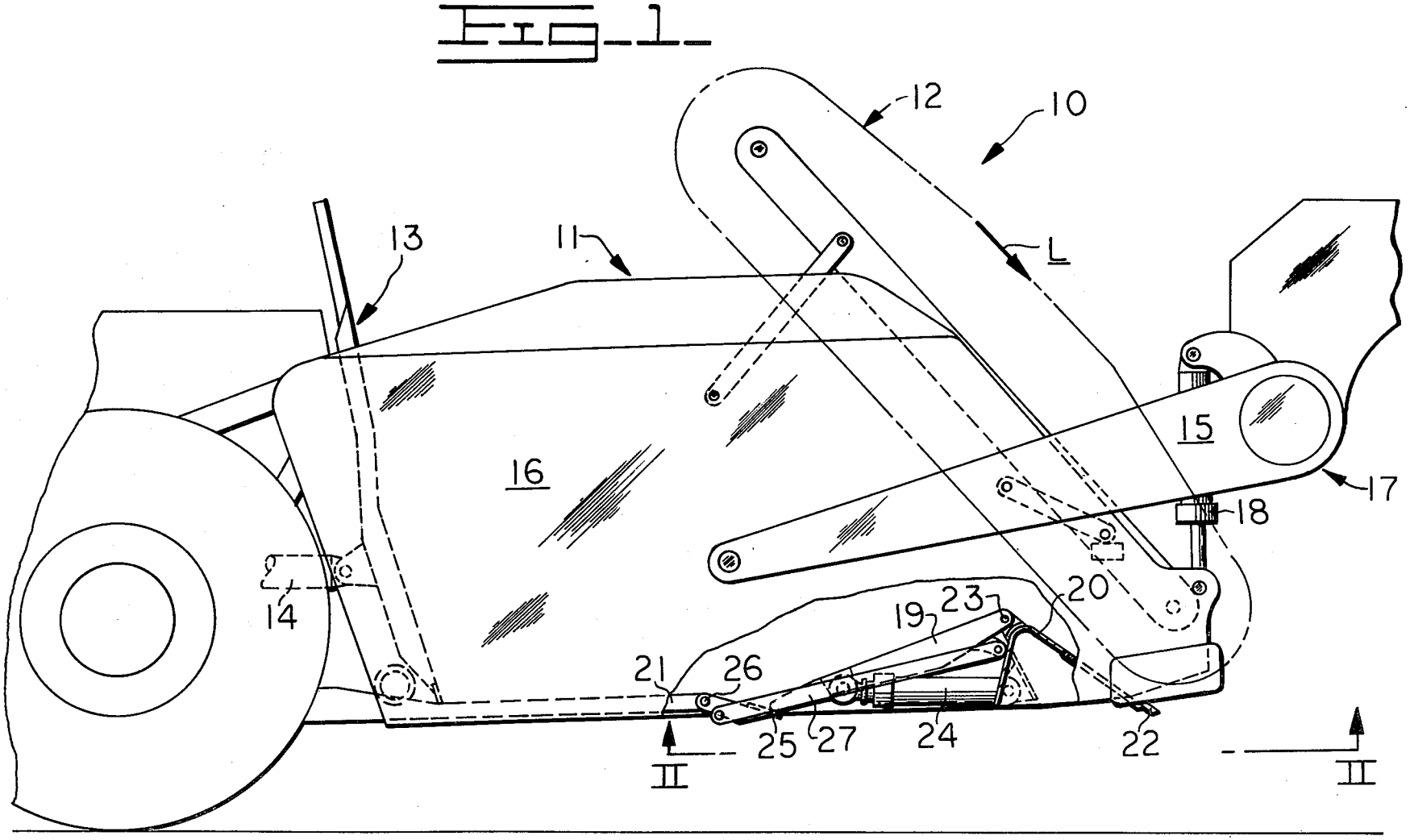
FIG. 1 is a partial side elevational view of a self-loading scraper having a movable floor panel of this invention mounted therein.
Figure 2:
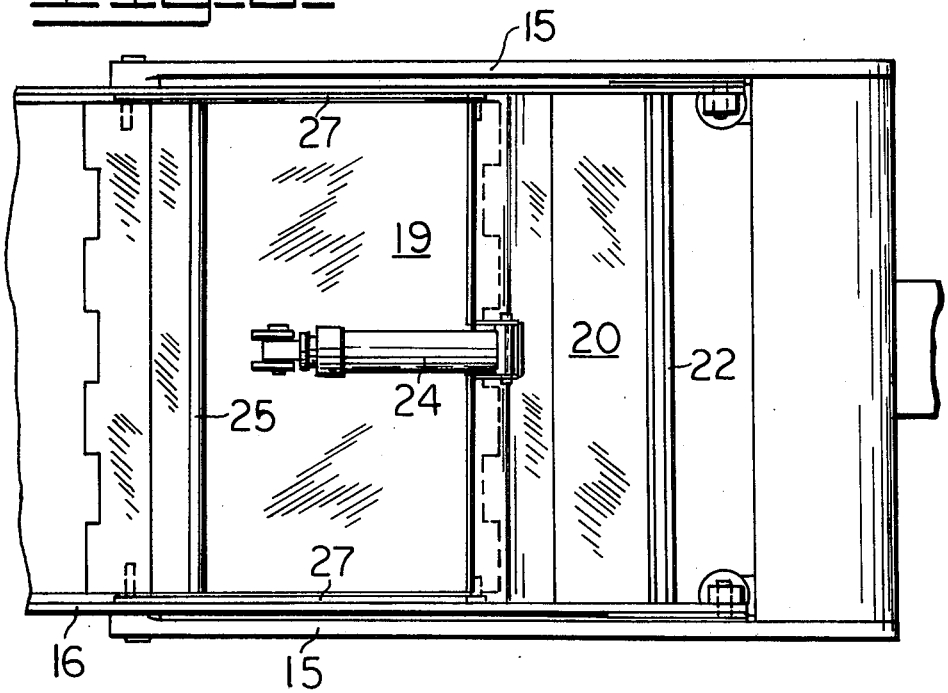
FIG. 2 is a bottom plan view of the floor panel and attendant structures, taken in the direction of arrows II—II in FIG. 1.

Referring to FIGS. 1 and 2, a self-loading scraper 10 comprises a bowl 11 having an elevator assembly 12 mounted on a forward end thereof and an ejector assembly 13 normally retracted by double-acting cylinder 14 to a rearward end of the bowl. A pair of draft arms 15 (one shown) are each pivotally interconnected between a respective sidewall 16 of the bowl and a draft frame 17 of a tractor in a conventional manner. A pair of double-acting hydraulic cylinders 18 (one shown) are pivotally interconnected between the draft frame and a forward end of the scraper bowl to selectively raise or lower the same during various phases of scraper operation.

Figure 3:
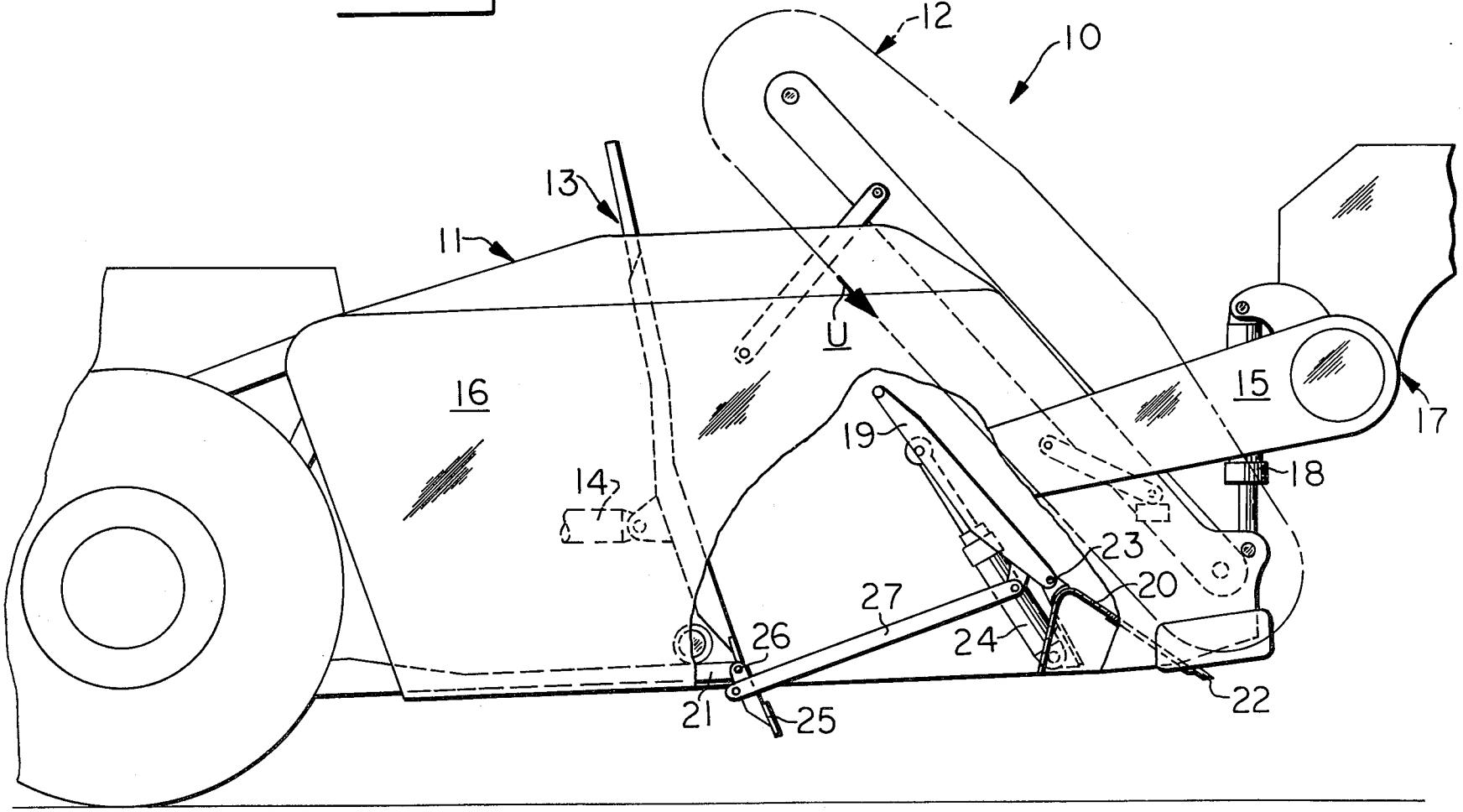
FIG. 3 is a view similar to FIG. 1, but illustrating the floor panel in an opened, generally upright position during an unloading phase of scraper operation.

This invention relates to the construction and arrangement of a movable floor panel 19 which is adapted to be moved selectively between its FIG. 1 closed position and its FIG. 3 opened position for purposes hereinafter explained. The floor of the bowl further comprises a stationary first panel or beam structure 20 disposed at a forward end of the bowl and secured between sidewalls 16. A stationary and substantially flat second panel 21 is secured between the sidewalls at a rearward end of the bowl in longitudinally spaced relationship relative to first panel 20 to define a rectangular opening therebetween normally closed by movable panel 19 (FIG. 2).

A downwardly sloping cutting edge 22 is secured on a forward end of first panel 20 whereas a first end of movable panel 19 is pivotally mounted on the rearward end of the first panel by a pivot means or pin 23 of a piano hinge. A double-acting hydraulic cylinder 24 is pivotally interconnected between first panel 20 and an underside of panel 19 to selectively raise the latter panel to its generally upright position, illustrated in FIG. 3, during the unloading phase of scraper operation.

In its FIG. 1, closed position the rearward end of movable panel 19 contacts the upper side of a strike-off plate 25, pivotally mounted by a pivot means or pin 26 of a piano hinge on a forward end of second panel 21. A pair of links 27 are pivotally interconnected between the strike-off plate and a forward end of movable panel 19 to automatically pivot strike-off plate downwardly upon extension of cylinders 24 (FIG. 3).

During the loading phase of scraper operation, cylinders 18 will function to lower bowl 11 to engage cutting edge 22 with the ground. The blade and elevator 12 (arrow L) will cooperate to load the bowl whereafter the bowl is raised to its raised FIG. 1 position for transport to a remote dump site. Referring to FIG. 3, the scraper bowl is unloaded by reversing the travel of the chain drives for elevator assembly 12, as indicated by an arrow U, to discharge material over cutting edge 22. Simultaneously therewith, cylinders 24 are extended to pivot floor panel 19 upwardly towards the elevator assembly to aid the elevator assembly in discharging material over cutting edge 22 and to open the floor to discharge material therethrough upon actuation of ejector assembly 13.

In particular, extension of cylinders 24 will simultaneously move strike-off plate 25 downwardly to aid in leveling material discharged from the bowl by ejector assembly 13. Upon emptying of the bowl, cylinders 14 are retracted to, in turn, retract the ejector assembly to its FIG. 1 position at a rearward end of the bowl. Cylinders 24 are then retracted to pivot panel 19 into its closed position on strike-off plate 25.

Figure 5:
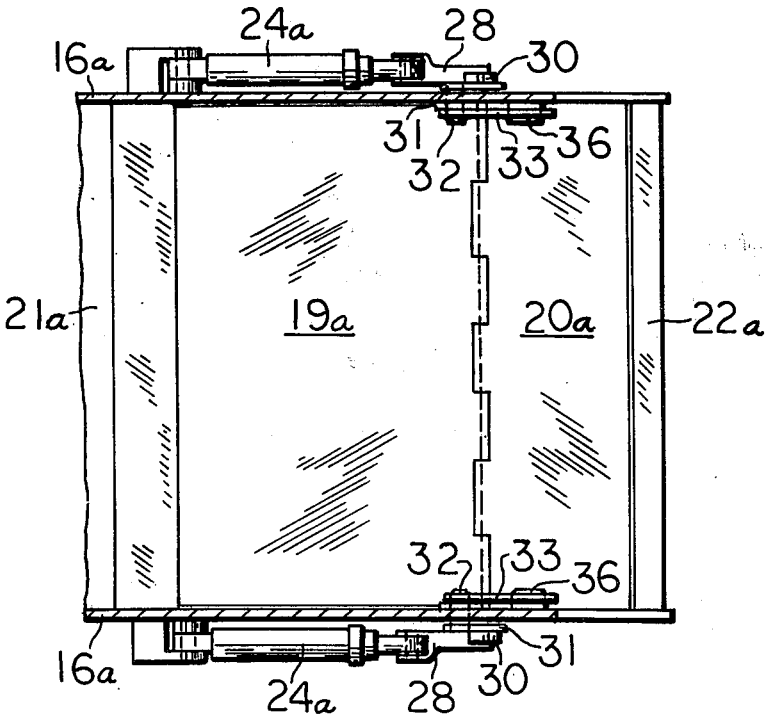
FIG. 5 is a top plan view of the modified floor panel, taken in the direction of arrows V—V in FIG. 4.
Figure 4:
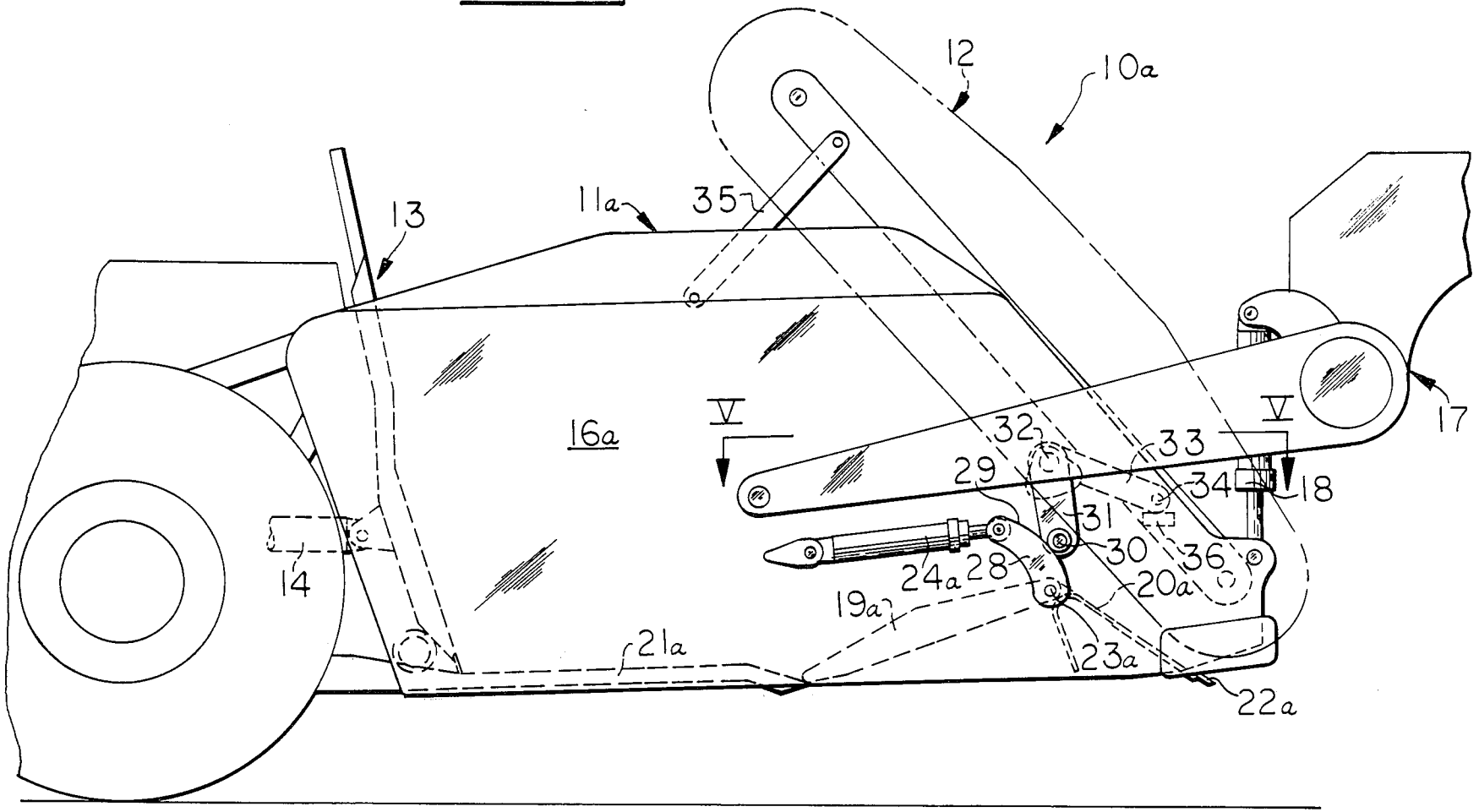
FIG. 4 is a view similar to FIG. 1, but illustrating a modification of the floor panel.
Figure 6:
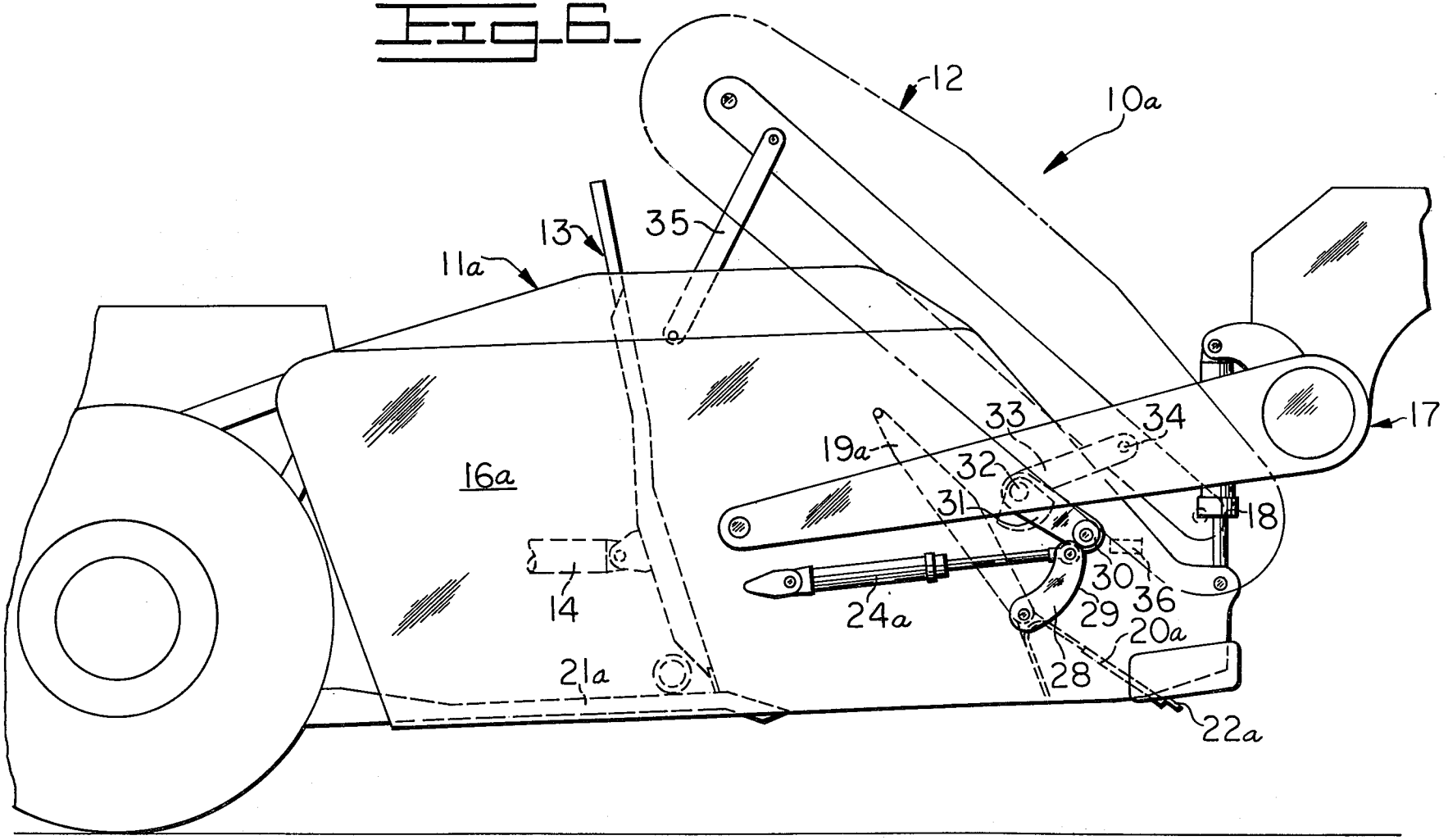
FIG. 6 is a view similar to FIG. 4, but illustrating the floor panel in an opened, generally upright position during an unloading phase of scraper operation.

FIGS. 4–6 illustrate scraper 10a modification of this invention wherein identical numerals depict corresponding constructions with numerals depicting modified constructions in these figures being accompanied by an *a*. Scraper bowl 11*a* comprises a pair of laterally spaced and upright sidewalls 16*a* having a first panel or beam structure 20*a* secured between forward ends thereof and a stationary and horizontally disposed second floor panel 21*a* secured at a rearward end thereof. A movable floor panel 19*a* is pivotally mounted on first panel 20*a* by a pivot means or pin 23*a* of a piano hinge. A lever 28 is secured on each lateral end of panel 19*a*.

A pair of double-acting hydraulic cylinders 24*a* are each pivotally interconnected between a respective sidewall 16*a* and a second end of each lever 28 to pivot panel 19*a* to its generally upright position illustrated in FIG. 6 upon extension of the cylinders. It should be understood that the FIGS. 4–6 scraper bowl modification could include a strike-off plate 25 (FIG. 1) pivotally mounted on a forward end of second panel 21*a* and operatively connected to panel 19*a* by links 19, if so desired.

Lever 28 has an arcuate cam surface 29 formed thereon to engage a roller 30 rotatably mounted on a first end of an arm 31, pivotally mounted on a respective sidewall 16*a* by a pivot pin 32. A second arm 33 is secured to pin 32 to form a bellcrank with arm 31. The second end of arm 33 is pivotally mounted to a frame structure of elevator assembly 12 by a pin 34 to move the lower end of the elevator away from a cutting edge 22*a* automatically upon extension of cylinders 24*a* (FIG. 6). The upper end of the elevator assembly is movably supported on the bowl by a pair of links 35 (one shown) pivotally interconnected therebetween. Stop means in the form of a block 36, secured to a respective sidewall of the bowl, is positioned to engage beneath arm 33 to precisely set the loading channel between elevator assembly and cutting edge 22*a*.

The FIGS. 4–6 self-loading scraper 10*a* functions in substantially the same manner as described above in connection with the loading and unloading operations of the FIGS. 1–5 scraper. The enlargement of the opening between the lower end of the elevator assembly and cutting edge 22*a* (FIG. 6) aids in the more expeditious unloading of material therethrough.

I claim:

1. In a self-loading scraper of the type comprising a bowl having a pair of upright sidewalls and a floor extending therebetween, an elevator assembly mounted on a forward end of said bowl, and an ejector assembly normally retracted rearwardly of said bowl, the improvement wherein said floor comprises stationary first and second panels secured between said sidewalls in longitudinally spaced relationship thereon to define an opening therebetween, a cutting edge secured on a forward end of said first panel, and a movable panel having a forwardly disposed first end thereof pivotally mounted on said first panel for movement to a generally upright position adjacent to said elevator assembly and a second end thereof normally disposed adjacent to a forward end of said second panel to cover said opening, and actuating means operatively interconnected between said movable panel and said bowl for selectively pivoting said movable panel forwardly and upwardly to its generally upright position adjacent to said elevator assembly and towards the forward end of said bowl to uncover said opening.

2. The scraper of claim 1 wherein said actuating means comprises at least one double-acting cylinder pivotally interconnected between said first panel and said movable panel.

3. The scraper of claim 2 wherein said actuating means is disposed below said movable panel.

4. The scraper of claim 1 further comprising a strike-off plate mounted on a forward end of said second panel.

5. The scraper of claim 4 wherein said strike-off plate is pivotally mounted on said second panel and further comprising link means pivotally interconnected between said movable panel and said strike-off plate for automatically pivoting said plate downwardly on said bowl in response to actuation of said actuating means to pivot said movable panel.

6. The scraper of claim 1 wherein said actuating means comprises at least one double-acting cylinder pivotally interconnected between a sidewall of said bowl and said movable panel.

7. The scraper of claim 6 wherein said actuating means further comprises a lever pivotally interconnected between said cylinder and a pivot means pivotally mounting said movable panel on said first panel.

8. The scraper of claim 7 wherein said elevator assembly is movably mounted on the forward end of said bowl and means operatively engaged with said lever for automatically raising a lower end of said elevator assembly relative to said bowl upon actuation of said actuating means to pivot said movable panel theretowards.

9. The scraper of claim 8 wherein said means engaged with said lever comprises a bellcrank pivotally mounted on said bowl and pivotally connected to said elevator assembly.

10. The scraper of claim 1 further comprising means operatively engaged with said actuating means for automatically raising a lower end of said elevator assembly relative to said bowl upon actuation of said actuating means to pivot said movable panel theretowards.

11. In a self-loading scraper of the type comprising a bowl having a pair of upright sidewalls and a floor extending therebetween, an ejector assembly normally retracted rearwardly of said bowl, the improvement wherein said floor comprises stationary first and second panels secured between said sidewalls in longitudinally spaced relationship thereon to define an opening therebetween, a cutting edge secured on a forward end of said first panel, and a movable panel having a forwardly disposed first end thereof pivotally mounted on said first panel and a second end thereof normally disposed adjacent to a forward end of said second panel to cover said opening, actuating means operatively interconnected between said movable panel and said bowl for selectively pivoting said movable panel towards the forward end of said bowl to uncover said opening, a strike-off plate pivotally mounted on said second panel and means for automatically pivoting said plate downwardly on said bowl in response to actuation of said actuating means to pivot said movable panel.

* * * * *